US005188155A

United States Patent [19]

Kremer

[11] Patent Number: 5,188,155

[45] Date of Patent: Feb. 23, 1993

[54] DEVICE FOR NEUTRALIZING A RESIDUAL-PRESSURE VALVE OF A GAS BOTTLE

[75] Inventor: Paul Kremer, Walferdange, Luxembourg

[73] Assignee: Ceodeau S.A., Lintgen, Luxembourg

[21] Appl. No.: 696,139

[22] Filed: May 6, 1991

[30] Foreign Application Priority Data

Jun. 20, 1990 [LU] Luxembourg ..... 87748

[51] Int. Cl.[5] ..... B65B 3/04

[52] U.S. Cl. ..... 147/65; 137/454.002; 29/252; 29/213.001; 141/348; 141/385; 251/63.005; 251/63.004

[58] Field of Search ..... 141/387, 384, 385, 348, 141/379, 65, 346, 347; 137/614.11; 251/63.4, 63.5, 63.6; 81/484, 488; 29/213.1, 221.6, 239, 252

[56] References Cited

U.S. PATENT DOCUMENTS

| | | | |
|---|---|---|---|
| 1,711,870 | 5/1929 | Zerk | 141/385 |
| 3,402,747 | 9/1968 | Tissot-Dupont | 141/348 |
| 3,517,688 | 6/1970 | Scholle | 251/63.6 |
| 3,786,550 | 1/1974 | Jones | 29/252 |
| 3,863,673 | 2/1975 | Sitton | 137/614.11 |
| 4,453,699 | 6/1984 | Hulsey et al. | 251/63.4 |
| 4,728,217 | 3/1988 | Fink | 29/252 |
| 4,815,692 | 3/1989 | Loiseau et al. | 251/63.5 |
| 4,869,300 | 9/1989 | Gudenau et al. | 141/65 X |
| 4,993,451 | 2/1991 | Kremer | 137/454.2 |
| 5,060,359 | 10/1991 | Muir | 29/252 |
| 5,072,950 | 12/1991 | Littleproud et al. | 29/213.1 |

FOREIGN PATENT DOCUMENTS

| | | | |
|---|---|---|---|
| 335282 | 12/1958 | France | 141/385 |

*Primary Examiner*—Ernest G. Cusick
*Attorney, Agent, or Firm*—Leydig, Voit & Mayer

[57] ABSTRACT

The device is intended for neutralizing a residual-pressure valve, without the need to remove it, for the purpose of filling the bottle. The device comprises a tubular housing (12) designed to be fastened, in the operative position, to a connection piece (2) of the bottle sealingly and comprising at least one first lateral connector (44) for connection to a gas source, a gripper (20) seated axially in the housing (12) and stressed by a spring (38) so as, in the operative position, to penetrate into the connection piece (2) round the rod (8) of the closing member (6), and an actuator for displacing the gripper (20) axially counter to the action of the spring (38) and for simultaneously closing it so as to drive the rod (8) and lift the closing member (6) from its seat.

8 Claims, 1 Drawing Sheet

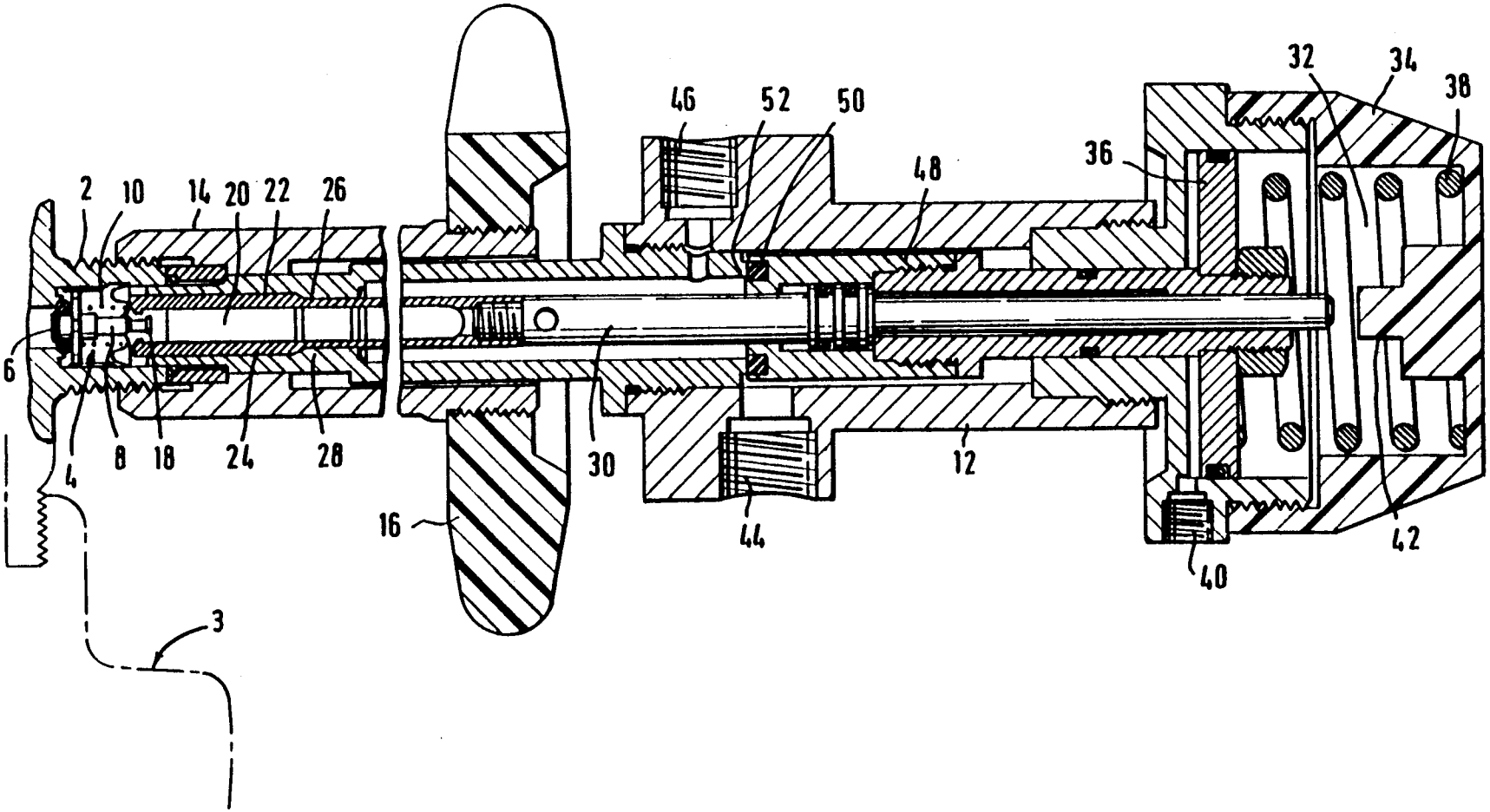
38
34
32
36
48
50
52
46
26
22
20
14
10
2
6
4
8
18
24
28
30
16
12
44
40
42
3

DEVICE FOR NEUTRALIZING A RESIDUAL-PRESSURE VALVE OF A GAS BOTTLE

The present invention relates to a device for neutralising a residual-pressure valve of a gas bottle, the said valve being mounted in the bore of a connection piece of the bottle head which is designed to be connected either to a circuit for receiving gas from the bottle, a circuit for filling the bottle with gas or a circuit for washing the bottle. The valve comprises a closing member which is stressed in the closing direction onto a seat under the action of a calibrated spring and counter to the action of the pressure of the gas in the bottle, the said closing member comprising a rod extending axially through the calibrated spring in the outlet direction of the connection piece.

A valve of this type is known from Luxembourg Patent No. 87,413 and from corresponding U.S. Pat. No. 4,993,451; the disclosure of the letter patent being incorporated herein by reference. Such a valve is intended for closing the outlet of the bottle automatically under the action of its calibrated spring when the pressure of the gases in the bottle falls below a predetermined value. The object is to prevent the possibility of emptying the bottle completely, in order to prevent impurities from penetrating into the bottle. The valve described in the abovementioned document is more particularly designed to be extracted easily and quickly, in order to free completely the connection piece allowing access into the bottle for the purpose of washing or filling the latter. This document also mentions the possibility of neutralising the valve for the purpose of filling the bottle, without the need to remove the valve. For this purpose, the document provides a suitable device for keeping the valve open counter to the action of its spring during the operation of filling the bottle.

The object of the present invention is to provide a simple and effective device for neutralising such a residual-pressure valve, without the necessity of removing the valve.

To achieve this object, the device provided by the present invention is characterised essentially by a tubular housing designed to be fastened, in the operative position, on the said connection piece sealingly and comprising at least one first lateral connector for connection to a gas source, a gripper seated axially in the said housing and stressed by a spring so as, in the operative position, to penetrate into the connection piece round the rod of the closing member, and means for displacing the gripper axially counter to the action of the spring and for simultaneously closing it so as to drive the said rod and lift the closing member from its seat.

The gripper preferably comprises at least two flexible claws which are closed by being brought nearer to one another under the effect of axial sliding on cams provided for this purpose on the inner wall of the housing.

In a preferred embodiment, the gripper is fastened to the end of a lengthening piece extending axially through the housing into a sealed chamber which is formed inside a cap fastened to the said housing and in which the lengthening piece is fixed to a piston stressed by the said spring and displaceable axially counter to the action of the spring under the effect of a pneumatic fluid, for the purpose of actuating the gripper.

The displacement of the piston counter to the action of the spring is preferably limited by an axial stop which is provided in the cap and the axial position of which can be adjusted from outside.

Furthermore, there can be a closing plug fixed to the lengthening piece in the region of the said first lateral connector, closing the passage from this connector towards the bottle under the action of the said spring and opening the said passage as a result of the pneumatic actuation of the gripper.

The housing preferably possesses a second lateral connector designed to be connected to a vacuum pump and located downstream of the said plug towards the gripper, the purpose of this being to generate a vacuum inside the housing before the filling of the bottle is carried out.

The housing can be screwed onto the connection piece of the bottle by means of a rotary sleeve surrounding the housing in the region of the gripper and equipped with an actuating handwheel. This avoids the need to rotate the entire device in order to screw it onto the connection piece.

Other particular features and characteristics will emerge from the detailed description of an advantageous embodiment given below by way of illustration, with reference to the single Figure which shows an axial section through a device according to the present invention.

This Figure illustrates a connection piece 2 for a gas bottle 3, the connection piece containing a residual-pressure valve 4 according to Luxembourg Patent No. 87,413 and corresponding U.S. Pat. No. 4,993,451. This valve, which comprises a closing member 6 with a rod 8 extending axially through the connection piece, is stressed by a calibrated spring 10, so as to close the outlet when the force of the spring 10 exceeds the force of the pressure of the gas in the bottle. The device provided by the present invention serves for neutralising the valve 4 by pulling on the rod 8 in opposition to the bias of the spring 10, in order to keep the closing member 6 in the open position, so that the bottle can be filled without the need to remove the valve 4.

The device provided consists of a tubular housing 12 which, for ease of mounting and dismounting, is produced in a plurality of internally threaded sections screwed onto one another, with gaskets interposed. This housing 12 is designed to be screwed onto the outlet connection piece 2 of the gas bottle. To avoid having to rotate the entire housing, the relevant part of the latter is equipped with a cylindrical sleeve 14 movable relative to the rest of the housing 12 and equipped at its end with an internal thread so that it can be screwed onto the connection piece 2. The sleeve 14 also possesses an actuating handwheel 16 for making it easier to tighten it and slacken it on the connection piece 2.

The active element of the device consists of a gripper 20 seated inside the housing 12 and designed to grasp the rod 8 of the residual-pressure valve 4. This rod has a mushroom-shaped head 18 for this purpose.

The gripper 20 consists of a plurality of, in this particular instance two flexible claws 22, 24 which are axially symmetrical and the free ends of which are in the form of a jaw for grasping the rod 8 behind the head 18. The inherent elasticity of the claws 22, 24 keeps them in the open position, as shown in the Figure, so as to be capable of penetrating round the head 18 of the rod 8 when the device is screwed onto the connection piece 2. Each of the claws 22 and 24 comprises a thin section responsible for their elasticity and a thicker section, the transition between these two sections forming an oblique ramp interacting with two cams 26, 28 provided on the inner wall of the housing 12. The gripper 20 is fastened to the end of a lengthening piece 30 which passes axially through the housing 12 and the opposite end of which penetrates into a cylindrical chamber 32 formed inside a cap 34 screwed onto the housing 12. The lengthening piece 30 is fixed to a piston 36 located in the chamber 32 and stressed by a spring 38 in order to keep the piston 36 and the lengthening piece 30 in the position shown in the Figure. The face of the piston 36 opposite that undergoing the action of the spring 38 can be subjected to the action of a pneumatic fluid injected via a pipeline (not shown) connected to the connector 40. The action of this pneumatic fluid is capable of displacing the piston 36 counter to the action of the spring 38, thereby driving the lengthening piece 30 and the gripper 20. However, this movement can be limited by a stop 42 detaining the head of the lengthening piece 30. This stop 42 is engaged, for example screwed, axially in the cap 34, and its position is preferably adjustable, for example by means of a screwdriver, from outside, so that the stroke of the piston 36 and of the gripper 20 under the action of the pneumatic fluid can be adjusted.

The reference 44 denotes a first connector designed to be connected to a gas source (not shown) for the purpose of filling the gas bottle. The reference 46 denotes a second connector designed to be connected to a vacuum pump, in order to empty and clean the interior of the device before and, where appropriate, after a filling.

The lengthening piece 30 possesses, inside the housing 12, a closing plug 48 equipped with a gasket 50 capable of being laid sealingly onto a peripheral seat 52 under the action of the spring 38 and of thereby closing the passage from the connector 44 towards the gas bottle when the gripper is not being actuated.

The functioning of the device for the purpose of filling the gas bottle will now be described. After the device has been screwed onto the connection piece 2, all the movable elements occupy the position shown in the Figure under the action of the spring 38. All the connectors are subsequently connected for intended use, namely the connector 40 to a compressed-air source, the connector 44 to a source of gas intended for filling the bottle and the connector 46 to a vacuum pump. The vacuum pump is subsequently activated in order to empty the air and all possible impurities in the space closed sealingly between the residual-pressure valve 4 and the gasket 50. Communication with the vacuum pump is thereafter closed by means of a tap (not shown), and the device is connected to the compressed-air source by means of the connector 40. The effect of this is to displace the piston 36 to the right in the Figure counter to the action of the spring 38, until the lengthening piece 30 is detained at the stop 42. The effect of this is that the gasket 50 is lifted from its seat 52, thus freeing the interior of the housing 12 for communication with the gas source. The sliding of the claws 22, 24 on the stationary cams 26 and 28 causes the gripper to close by bringing the jaws of the claws nearer to one another, and the movement to the right drives the rod 8 and opens the valve 4 as long as the piston 36 is subjected to the action of the compressed air. The gas is therefore free to pass from the connector 44, through the valve 4 and into the interior of the bottle. When the latter is full, the piston 36 is disconnected from the compressed air, thus allowing the spring 38 to return all the elements into the position of the Figure, that is to say to cut off communication with the gas source by closing the passage in the region of the gasket 50 and to open the gripper so as to free the valve 4 for the action of its spring 10 and displace the closing member 6 onto its seat. The filling phase can then be followed by an evacuation of the interior of the housing 12 by connecting the connector 46 to the vacuum pump once again.

I claim:

1. A device adapted for use with a gas bottle having a connection piece with a bore having a seat and containing a residual-pressure valve, said valve having a valve member and having a calibrated spring urging said valve member in a closing direction against said seat and counter to the action of the pressure of gas in the bottle, said valve including a rod attached to said valve member and extending axially outwardly through said spring, said device being adapted to selectively move said valve member in an opening direction and comprising a tubular housing having fastening means adapted to secure said housing sealingly to said connection piece, said housing having a first lateral connector adapted for connection to a source of gas and having means for conducting gas from said lateral connector to said bottle, a gripper slidable axially in said housing, biasing means in said housing and adapted to bias said gripper into said connection piece and into an operative position around said rod when said housing is secured to said connection piece means for displacing said gripper axially in opposition to said biasing means, and closing means in said housing and responsive to axial displacement of said gripper for closing said gripper on said rod thereby to cause said gripper to move said valve member in said opening direction.

2. A device according to claim 1 in which said housing includes an inner wall, said closing means comprising cam surfaces on said inner wall, said gripper comprising at least two flexible claws engageable with said cam surfaces and movable toward one another by said cam surfaces when said gripper is displaced axially in opposition to said biasing means.

3. A device according to claim 1 further including a chamber defined within said housing, a piston slidable within said chamber, a lengthening piece disposed within said housing and connected between said gripper and said piston, said displacing means including means for admitting pressure fluid into said chamber to move said piston, said lengthening piece and said gripper axially in opposition to said biasing means.

4. A device according to claim 3 further including a cap fastened to said housing, said biasing means being located between said cap and said piston, and a stop on said cap and operable to limit movement of said piston, said lengthening piece and said gripper when pressure fluid is admitted into said chamber.

5. A device according to claim 4 in which said stop extends axially into said cap and is axially adjustable from outside the cap.

6. A device according to claim 3 in which said means for conducting gas from said lateral connector to said bottle comprises a passage in said housing, a closing plug on said lengthening piece and establishing communication between said connector and said passage when said lengthening piece is moved by pressure fluid admitted into said chamber, said biasing means urging said closing plug to a position blocking communication between said connector and said passage.

7. A device according to claim 6 in which said housing further includes a second lateral connector adapted for connection to a vacuum source and communicating with said passage between said closing plug and said bottle, said biasing means urging said closing plug to a position blocking communication between said first and second connectors.

8. A device according to claim 1 in which said securing means comprise a rotary sleeve surrounding said housing in proximity to said gripper, and a handwheel attached to said sleeve for rotating said sleeve.

* * * * *